United States Patent [19]

Mondini

[11] Patent Number: 4,972,553

[45] Date of Patent: Nov. 27, 1990

[54] COMBING DEVICE AND METHOD OF PROCESSING STAPLE FIBERS

[75] Inventor: Gian C. Mondini, Winterthur, Switzerland

[73] Assignee: Rieter Machine Works, Ltd., Winterthur, Switzerland

[21] Appl. No.: 335,823

[22] Filed: Apr. 10, 1989

[30] Foreign Application Priority Data

Apr. 8, 1988 [CH] Switzerland ..... 01305/88

[51] Int. Cl.[5] ..... D01G 19/16

[52] U.S. Cl. ..... 19/225; 19/215

[58] Field of Search ..... 19/105, 215, 223, 225, 19/235, 227, 229

[56] References Cited

U.S. PATENT DOCUMENTS

| | | | |
|---|---|---|---|
| 875,932 | 1/1908 | Jolly et al. | 19/229 |
| 1,056,137 | 3/1913 | Wenning | 19/223 |
| 2,572,122 | 10/1951 | Dudley et al. | 19/225 |
| 3,479,699 | 11/1969 | Von Kaenel et al. | 19/223 |
| 4,068,351 | 1/1978 | Schmiel et al. | 19/105 |
| 4,240,180 | 12/1980 | Wood et al. | 19/105 |
| 4,672,717 | 6/1987 | Shimomura | 19/235 |

*Primary Examiner*—Werner H. Schroeder
*Assistant Examiner*—Michael A. Neas
*Attorney, Agent, or Firm*—Kenyon & Kenyon

[57] ABSTRACT

The combing device supplies a lap of staple yarn to a nipper unit which, in turn, presents a tuft of the lap to a rotating comb cylinder for combing of the tuft. Thereafter, the combed tuft is delivered by the nipper unit directly to a pair of detaching rollers for detaching of the combed tuft from the lap. The elimination of a tuft comb allows a higher weight for the lap and, hence, increased production of the combing device. The combed tuft can then be drawn and spun into yarn, for example, by ring spinning.

7 Claims, 1 Drawing Sheet

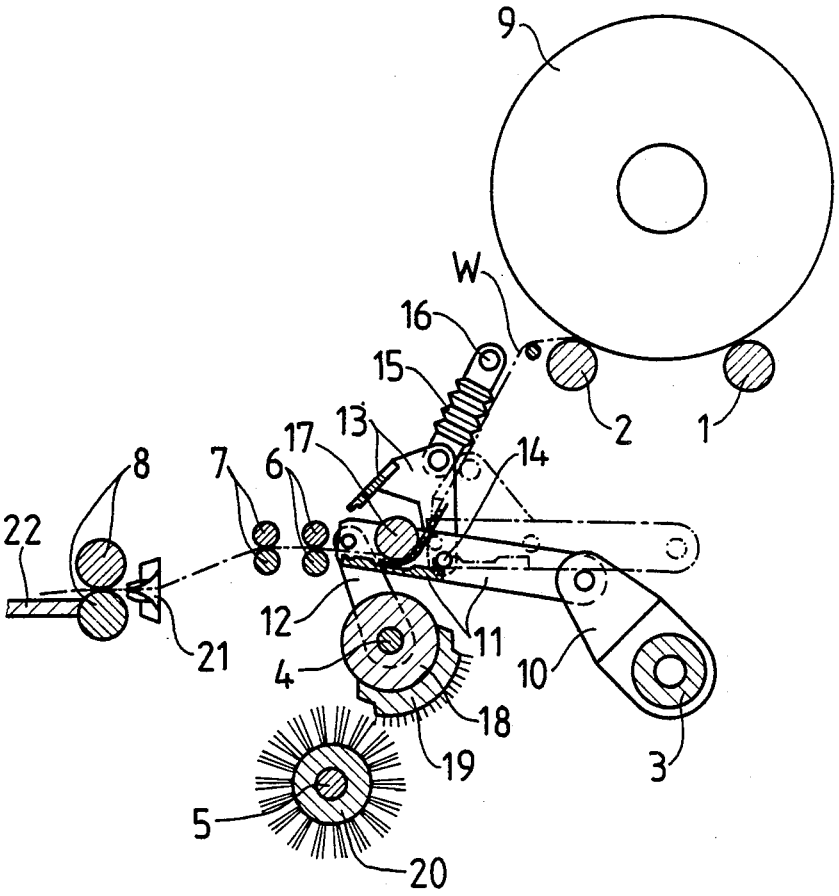
9
W
16
15
13
17
14
2
1
8
7
6
22
12
11
21
4
10
18
19
3
5
20

COMBING DEVICE AND METHOD OF PROCESSING STAPLE FIBERS

This invention relates to a combing device for staple fibers. More particularly, the invention relates to a method of processing carded staple fibers into spun yarn.

As is known, a carded sliver is generally used for the processing of staple fibers into yarn. In such cases, the carded sliver is drawn in at least one drawframe and, thereafter, spun into yarn.

Usually, carded sliver contains a certain number of neps, that is, knots in and between the individual fibers. When a conventional ring spinning method is used for the spinning of the yarns, the neps tend to concentrate on the surface of the spun yarn. As a result, the surface neps may interfere with the processing of the yarn, for example, into woven or knitted fabrics. This is one of the reasons why the carded sliver is initially combed in a combing machine for the manufacture of high-grade yarn by a ring spinning method.

In addition to the ring spinning method, there are a number of more recent spinning methods which basically allow much higher production speeds, for example, in particular, open-end rotor spinning, open-end friction spinning, false-twist spinning, air-jet spinning and wrap-spinning. When these spinning methods are applied, the neps contained in the staple fiber material come to lie largely in the interior of the yarn and occur only to a negligible extent at the surface of the yarn, where they may cause interference. As a result, the use of a combing machine has hitherto been considered superfluous or at least not economical for these spinning methods.

Combing machines which are of conventional construction today are constructed to feed fibers in the form of a lap to a nipper which presents each tuft initially to a rotating comb cylinder for combing out of the front end of the tuft, and then delivers the tuft to detaching rollers through a top comb or penetration comb which combs out the rear end of the tuft. The maximum production achieved in such machines with a work station width of 300 millimeters mm, for example, is about 6 to 8 kilograms/hour (kg/h) per work station given a lap weight of 60 to 70 ktex maximum.

Accordingly, it is an object of the invention to produce an improved spun yarn.

It is another object of the invention to simplify the construction of a combing machine for yarn which is to be spun.

It is another object of the invention to improve the quality of a spun yarn which has been produced from carded staple fibers.

Briefly, the invention provides a method of processing carded staple fibers into spun yarn wherein a lap of staple yarn is first fed into a nipper unit. Thereafter, a tuft of the lap is combed while held in a closed position of the nipper unit and the combed tuft is then passed directly to a nip between a pair of detaching rollers in order to detach the tuft from the lap and without further combing. Thereafter, the combed tuft is passed from the detaching rollers into at least one drawframe prior to spinning into a yarn whereby neps contained in the stapled yarn come to lie largely in the interior of the yarn.

The invention also provides a combing device for staple fibers which is comprised of a supply means for supplying a lap of staple yarn, a nipper unit for receiving the lap of staple yarn from the supply means, a rotatable comb cylinder and a pair of detaching rollers.

The nipper unit is constructed to be movable between a withdrawn closed position in order to hold a tuft of the lap therein and an advanced open position to release the tuft therefrom.

The rotatable comb cylinder is positioned for combing the tuft of the lap which is held in the nipper unit when the nipper unit is in the withdrawn closed position.

The detaching rollers are positioned to detach the tuft of the lap directly from the nipper unit when the nipper unit is in the advanced open position without further combing of the tuft.

It has been found that the maximum lap weight and hence the maximum possible production in combing a conventional machine is largely limited by the top comb or penetration comb which combs out the rear ends of the tuft. In the present case, since the tufts are fed after combing by the comb cylinder directly to the detaching roller nip without contacting other combing elements, the lap weight and hence the combing device production can be significantly increased, e.g. by about 25 to 30% over conventional machines. Although the neps contained in the fiber material are only partially removed in this process, this does not prove to have an adverse effect subsequently since the remaining neps come to lie largely in the interior of the yarn in the subsequent spinning process. The desired improvement of the manufactured yarn is obtained, not only by the partial removal of the neps but also by the removal of trash and the combing out of short fibers by means of the comb cylinder.

These and other objects and advantages of the invention will become more apparent from the following detailed description taken in conjunction with the accompanying drawing wherein:

The drawing diagrammatically illustrates a vertical sectional view through the central parts of a combing device constructed in accordance with the invention.

Referring to the drawing, the combing device employs, in conventional manner, a supply means in the form of a pair of rollers 1, 2 for supplying a lap 9 of carded yarn, a nipper unit for receiving the lap 9, a comb cylinder shaft 4 and a brush shaft 5. The nipper unit is actuated by a nipper shaft 3 which is rotatable with an oscillatory motion and includes a bottom nipper 11 and a top nipper 13. The rear end of the bottom nipper 11 is pivotally connected to a crank arm 10 which is mounted on the nipper shaft 3 to oscillate therewith and is connected at the front end to a link 12 which, in turn, is mounted to pivot about the comb cylinder shaft 4. The top nipper 13 is connected to the bottom nipper 11 so as to pivot about a pivot pin 14. The top nipper 13 is also articulated on the bottom ends of springs, each of which is encased in a bellows 15. The top ends of the springs are pivotable about pivots 16 fixed to a frame (not shown) of the combing device.

During operation, the oscillatory rotation of the nipper shaft 3 and, hence, of the crank arm 10, causes the bottom nipper 11 to move between the solid-line advanced front position and the broken-line withdrawn position. In the advanced position, the nipper unit 11, 13 is opened while in the withdrawn position, the nipper unit 11, 13 is closed.

As illustrated, an intermittently rotatable feed roller 17 is also mounted in the bottom nipper 11 for the feeding of the lap 9 to between the ends of the nippers 11, 13.

The comb cylinder shaft 4 is continuously rotating in a conventional manner and carries a comb cylinder 18 having a segment 19 carrying combing teeth. The likewise continuously rotating brush shaft 5 carries a comb cylinder brush 20.

The combing device also has two pairs of detaching rollers 6, 7 and a pair of delivery rollers 8, all mounted in a machine frame (not shown). In addition, a sliver funnel 21 is positioned upstream of the delivery rollers 8 while a delivery table 22 is positioned immediately downstream of the delivery rollers 8.

The combing device is used in processing carded staple fibers into yarn with the use of a spinning method in which neps contained in the staple fiber material come to lie largely in the interior of the yarn.

When in use, the lap 9 is first formed on a lap machine (not shown) from a number of card slivers. The lap 9 is then fed to the lap supply rollers 1, 2 with the lap W being unwound as a result of the rotation of the lap rollers 1, 2. The unwound lap then passes to the feed roller 17 in the nipper unit 11, 13 and passes into the nip of the nippers 11, 13. The nipper unit is then moved into the withdrawn closed position to hold a tuft of the lap 9 therein while presenting the tuft to the rotating comb cylinder 18. The cylinder 18 then combs the tuft of the lap 9 by means of the comb cylinder segment 19.

The bottom nipper 11 is then moved into the advanced front position, during which the nipper unit 11, 13 opens. In this position, a free space is available between the front end of the bottom nipper 11 and the first pair of detaching rollers 6. The top comb or penetration comb which is provided here in known combing machines is, in this case, absent. The combed tuft is thus fed directly to a pair of detaching rollers 6 without any obstruction by further combing elements. The lap W can therefore, for example, be about 25% thicker than in known combing machines. With a conventional width of 30 centimeters (cm) for the lap W, the lap may have a weight of more than 75 ktex and preferably more than 90 ktex, i.e. more than 250 grams/square meter ($g/m^2$) and preferably more than 300 grams/square meter ($g/m^2$) and hence, it follows, a production of more than a kilogram per hour per work station.

The detaching rollers 6 which perform a pilgrim step movement in the conventional way, combine the tuft with the previously combed lap and detach the combed tuft from the lap in the nipper unit 11, 13. The nipper unit 11, 13 is then again moved into the rear position and the cycle starts afresh. The combed lap passes from the pair of detaching rollers 6 through the second pair of rollers 7, the sliver funnel 21 and the pair of delivery rollers 8 and then in the form of combed sliver onto the delivery table 22.

The combed sliver is usually twisted with other combed slivers from other work stations in the same machine. The twisted sliver is then drawn in a number of drawframes successively and then formed into a yarn by a spinning method. The spinning method used is one in which neps left in the combed sliver come to lie largely in the interior of the yarn. Spinning methods of this kind are, more particularly, open-end rotor spinning, friction spinning, false-twist spinning, air-jet spinning and wrap-spinning. The resulting yarn therefore has practically no surface neps which might interfere with further processing of the yarn, e.g. into woven or knitted fabrics.

The invention thus provides a combing device and process whereby a quality spun yarn can be produced. In this respect, neps appearing in the carded yarn reside within the interior of the spun yarn which is produced. In addition, by employing a heavier lap, the quality of the yarn can be improved.

The invention further eliminates the need for a top comb for the combing of the tuft in the nipper unit. This, in turn, allows a higher weight for the lap and, hence, increased production of the combing device. A yarn improvement can thus be obtained economically.

What is claimed is:

1. In a method of processing carded staple fibers into spun yarn, the steps comprising feeding a lap of staple yarn into a nipper unit;

combing a tuft of the lap while held in a closed position of the nipper unit;

passing the combed tuft of the lap without further combing directly to a nip between a pair of detaching rollers to detach the tuft from the lap; and thereafter passing the combed tuft from the detaching rollers into at least one drawframe prior to spinning into a yarn whereby neps contained in the staple yarn lie largely in the interior of the yarn.

2. A method as set forth in claim 1 wherein the lap is fed with a weight per unit area of at least 250 grams per square meter.

3. A method as set forth in claim 1 wherein the lap is fed with a weight per unit area of at least 300 grams per square meter.

4. A method as set forth in claim 1 which further comprises the step of spinning the combed tuft drawn in the drawframe into yarn in accordance with one of the methods selected from the group consisting of open-end rotor spinning, open-end friction spinning, false-twist spinning, air-jet spinning and wrap-spinning.

5. In a method of processing carded staple fibers into spun yarn, the steps comprising feeding a lap of staple yarn having a weight of more than 75 KTEX into a nipper unit;

combing a tuft of the lap while held in a closed position of the nipper unit;

passing the combed tuft of the lap without further combining directly to a nip between a pair of detaching rollers to detach the tuft from the lap without further combing of the tuft; and thereafter passing the combed tuft from the detaching rollers into at least one drawframe prior to spinning into a yarn whereby neps contained in the staple yarn lie largely in the interior of the yarn.

6. A method as set forth in claim 5 wherein the lap is fed with a weight per unit area of at least 300 grams per square meter.

7. A combing device for staple fibers comprising supply means for supplying a lap of staple yarn;

a nipper unit for receiving the lap of staple yarn from said supply means, said nipper unit being movable between a withdrawn closed position to hold a tuft of the lap therein and an advanced open position to release the tuft therefrom;

a rotatable comb cylinder for combing the tuft of the lap held in said nipper unit in said withdrawn closed position; and a pair of detaching rollers for detaching the tuft of the lap directly from said nipper unit with said nipper unit in said advanced open position and without further combing of the tuft.

* * * * *

UNITED STATES PATENT AND TRADEMARK OFFICE

CERTIFICATE OF CORRECTION

PATENT NO. : 4,972,553

DATED : November 27, 1990

INVENTOR(S) : GIAN C. MonDINI

It is certified that error appears in the above-identified patent and that said Letters Patent is hereby corrected as shown below:

Column 3, line 45, change "a kilogram per" to --8 kilograms per--.

Signed and Sealed this

Thirtieth Day of June, 1992

*Attest:*

DOUGLAS B. COMER

*Attesting Officer*

*Acting Commissioner of Patents and Trademarks*